United States Patent [19]

Sethi et al.

[11] 4,212,673

[45] Jul. 15, 1980

[54] FILM UNIT ASSEMBLY

[75] Inventors: Gurdip S. Sethi, Rochester; Karl Sperber, Hilton; Donald G. Tidd, Palmyra, all of N.Y.

[73] Assignee: Eastman Kodak Company, Rochester, N.Y.

[21] Appl. No.: 931,079

[22] Filed: Aug. 4, 1978

[51] Int. Cl.[2] ..... G03C 1/76; G03C 1/72

[52] U.S. Cl. ..... 430/496; 352/102; 354/121; 355/72

[58] Field of Search ..... 96/67, 78, 79; 354/203, 354/121; 352/102, 103; 353/120; 40/349; 355/21, 54, 72

[56] References Cited

U.S. PATENT DOCUMENTS

| | | | |
|---|---|---|---|
| 1,434,026 | 10/1922 | Sandell | 352/102 |
| 2,494,495 | 1/1950 | Tait et al. | 355/21 |
| 3,011,013 | 11/1961 | Sandkuist | 156/305 X |
| 3,030,260 | 4/1962 | Meizler | 156/305 |
| 3,612,614 | 10/1971 | Ware | 156/305 X |
| 3,963,335 | 6/1976 | Horvath | 353/15 |

*Primary Examiner*—Edward C. Kimlin
*Attorney, Agent, or Firm*—J. A. Matthews

[57] ABSTRACT

A photographic film unit, including a film disk carried on a hub, has a mass of firm material deposited between the disk and the hub so that the mass, rather than the dimensions of the respective parts, accurately determines the relative film-to-hub alignment. The hub initially fits loosely in a central film-disk aperture. The material, a thermo-plastic, is then melted ultrasonically to flow between the disk and the hub, eliminating the looseness, and maintaining the disk on the hub in accurate alignment. According to one disclosed embodiment, the thermoplastic material adheres a retainer ring to the hub with the film disk captured therebetween. The thermoplastic then fills the interstices between the ring, the hub, and the disk to exclude foreign matter, such as processing fluids.

13 Claims, 10 Drawing Figures

FILM UNIT ASSEMBLY

BACKGROUND OF THE INVENTION

1. Field of the Invention

The present invention relates to photographic film units including a disk of sheet film carried on a centrally located hub, and to methods of assembling such units. More specifically, the invention relates to structure and methods for accurately aligning a film disk on a central hub.

2. Brief Description of the Prior Art

U.S. Patent Application Ser. No. 774,716, entitled PHOTOGRAPHIC FILM UNIT AND CARTRIDGE ASSEMBLY, filed in the name of Donald M. Harvey on Mar. 7, 1977, discloses a miniature film unit that includes a disk of photosensitive sheet film supported on a hub. The hub is received through a central aperture in the film disk and is permanently attached thereto by a protruding hub finger, heat deformed onto the surface of the film. Alignment between the hub and film is predetermined by their respective dimensions, including their relative diameters, and by a key on the disk which fits closely in a hub keyway.

A more recent film-disk embodiment is depicted in U.S. Patent Application Ser. No. 931,053, entitled PHOTOGRAPHIC FILM CARTRIDGE ASSEMBLY AND CAMERA, filed in the name of Gurdip S. Sethi on even date herewith. In the Sethi embodiment, the disk is secured to the hub by trapping the disk between a hub flange and a retaining ring. Again, alignment between the hub and the disk is established by their respective dimensions.

Although the above-mentioned film disks offer many advantageous features, important advantages of the present invention are not available from the teaching of the prior art. By way of example only, the film units described above rely on the dimensions of the respective film unit parts to predetermine their assembled alignment. This causes a chain of undesirable tolerance requirements, from matched production lines, that must produce nearly identical parts, to final assembly equipment, that must rapidly mount one tight fitting part onto another. Additionally, there is a tendency for foreign matter to collect at the interfaces between the parts. During processing, for example, solutions from one processing bath may be transferred to and contaminate subsequent processing baths. Similarly, when the film unit is dried by spinning, a particularly desirable method, solution trapped at the interface may run across the film disk, causing streaks in the developed image.

SUMMARY OF THE INVENTION

In accordance with the present invention, an assembled photographic film unit, including a disk of sheet film carried on a central hub, is provided with a mass of firm material deposited between the film and the hub so that the mass, rather than the dimensions of the respective parts, accurately determines the relative film-to-hub alignment.

In a preferred embodiment, the assembly further includes a retainer ring, and the deposited material, a hardened thermoplastic, adheres the ring to the hub with the film disk captured therebetween. The mass additionally occupies the interstices between the hub, the film, and the ring, to exclude foreign matter such as processing solutions.

In the preferred embodiment, the hub also includes a cylindrical rim and a post adapted to mate loosely with a central aperture and an additional aperture, respectively, of the film disk. The hardened thermoplastic then eliminates the looseness at both the rim and the post, and secures the film on the hub in accurate radial and angular alignment.

During assembly of the film unit, the hub and the film disk, which are dimensioned to fit together loosely, are supported in accurate relative alignment. The looseness is then removed by flowing the thermoplastic material between the hub and the film disk.

Other features and advantages of the invention will become apparent to those skilled in the art from the following detailed description of the presently preferred embodiment.

BRIEF DESCRIPTION OF THE DRAWINGS

Reference is made to the accompanying drawings, in which.

DESCRIPTION OF THE PRESENTLY PREFERRED EMBODIMENT

Film units of the type with which the presently preferred embodiment will be disclosed, and cooperating cartridge assemblies, are fully illustrated and described in the previously-mentioned Harvey and Sethi applications. The disclosure of the Sethi application, Ser. No. 931,053, is incorporated by reference into this disclosure, so that the remainder of the description can be directed more particularly to elements forming part of or cooperating directly with the present invention.

Figure 1:
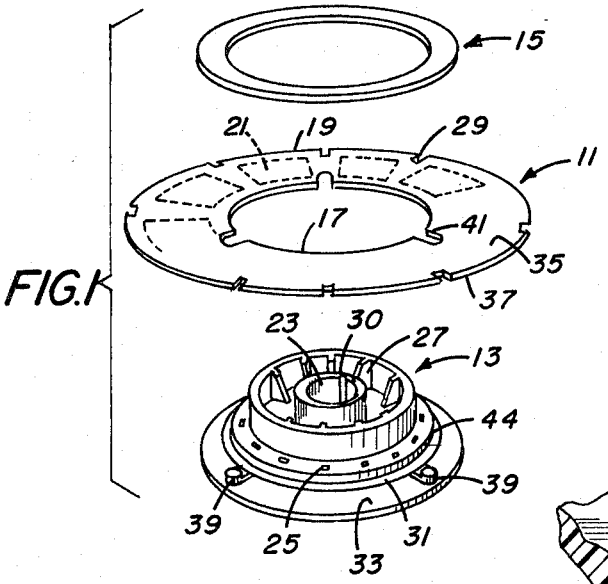
FIG. 1 is an exploded perspective view of the film unit depicting the hub, film disk, and retainer ring prior to assembly.
Figure 7:
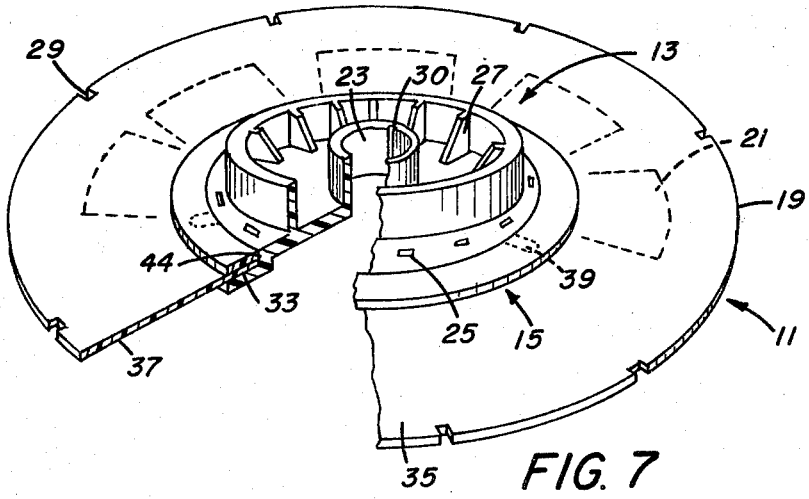
FIG. 7 is a perspective view of the film unit of FIG. 1, but depicting the unit fully assembled with the film disk captured between the hub and the retainer ring in accurate alignment with the hub.

Referring now to FIGS. 1 and 7, the preferred embodiment of the film unit is depicted as comprising a film disk 11, a hub 13 and a retainer ring 15.

The film disk is a flat sheet of moderately-flexible but self-supporting material, coated with suitable photosensitive layers for recording latent images. The sheet is configured like an annular ring having coaxial generally-circular perimeters, including a central aperture 17 and an outer periphery 19. Between the disk perimeters, and concentric therewith, a plurality of image areas 21 are defined by photographically pre-exposed border frames that are precisely positioned on the disk, during its manufacture, prior to assembly of the film unit.

The film disk is supported on the hub 13 (FIG. 7) to facilitate its handling in cooperating camera apparatus and during processing and printing. By way of example only, and as disclosed more fully in the Sethi application, central sleeve 23 is adapted to be received on a camera spindle to locate the film disk radially in such apparatus, and to provide an axis of rotation about which the respective image frames are successively indexable to a camera exposure position. Such rotational indexing is assisted by hub apertures 25 and lugs 27, which are adapted to be engaged, respectively, by indexing and anti-backup pawls, and by disk notches 29, which are adapted to be engaged by a metering mechanism. The central sleeve also includes a keyway 30 which is adapted, for example, to cooperate with spindles in processing and printing apparatus for establishing the angular position of the film unit on the spindle and preventing relative rotation therebetween.

Figure 2:
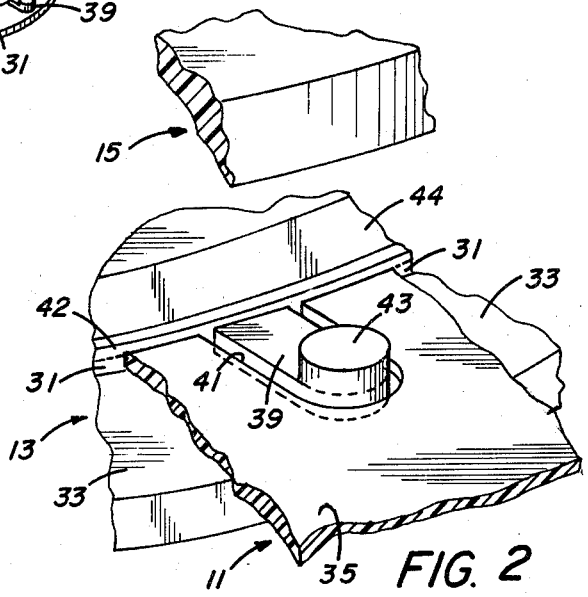
FIG. 2 is a partial perspective view of the film unit shown in FIG. 1, illustrating a portion of the film disk loosely received on the hub with the retainer ring thereabove.

The film disk is retained on the hub, around a cylindrical rim 31, (FIG. 2) by capturing the disk between the retainer ring 15 and a radially extending annular flange 33. The ring and flange engage opposite faces 35 and 37 of the disk, while the cylindrical rim is received within the disk aperture 17 (FIG. 1). This method is preferred over others, such as direct welding between the disk and hub, because it reduces stresses that tend to distort the disk from a flat film plane.

The hub further includes three spokes 39 spaced equidistant around the rim 31 and extending radially outward therefrom along flange 33. The spokes are received in corresponding film-disk apertures 41, which define radial notches communicating with the central aperture. The spokes obstruct relative angular movement between the film disk and the hub, without distorting the disk.

Referring now more specifically to the features of the present invention, the film disk and hub are configured to fit together loosely, so that their respective dimensions do not determine their relative alignment, except within only approximate limits. The central film-disk aperture 17 has a diameter larger than that of the hub rim 31, and is configured to receive the rim with sufficient clearance to permit adjustments during assembly in the relative radial alignment between the hub and the disk. Similarly, the hub spokes 39 are narrower and shorter than the disk notches 41 and are configured to clear the notches sufficiently to permit adjustments in the relative angular alignment between the disk and the hub. In the preferred embodiment, such clearances, at the rim and the spokes, are approximately 0.15 centimeters.

Figure 3:
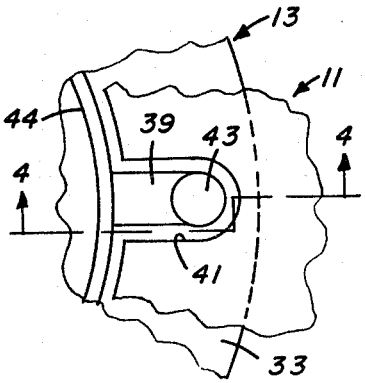
FIG. 3 is a top view corresponding to FIG. 2, but with the retainer ring removed to clearly illustrate the loose fit between the hub and film disk.
Figure 4:
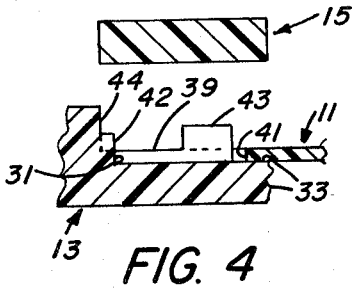
FIG. 4 is a front elevational view corresponding to FIG. 2, illustrating a band and post of thermoplastic material which are melted, during assembly of the film unit, to flow between the film disk and the hub.

With the film disk and hub held in accurate alignment by the assembly equipment, material is deposited therebetween, to secure the disk and hub in accurate alignment both radially and angularly. As depicted most clearly in FIGS. 2–4, the deposited material is a hardened thermoplastic melted from a band 42, which comprises an axial extension of rim 31, and from a post 43, which extends axially at the end of each spoke. The melted material flows from the band and from the post into the spaces between the hub and the disk, and then hardens to maintain the hub-to-disk alignment established by the assembly equipment.

The thermoplastic material also serves to adhere the retainer ring 15 to the hub. The inside diameter of the ring is approximately the same as an annular step 44 in the hub, which is smaller in diameter than the rim 31 or band 42. When the ring is positioned on the hub, it rests on top of the band and post. The band and post are then melted, and the ring is pressed axially onto the hub, causing the filling thermoplastic to spread and flow from the band and the post into the spaces between the hub, the film disk, and the ring. When the thermoplastic hardens, it adheres the retaining ring to the hub.

Figure 5:
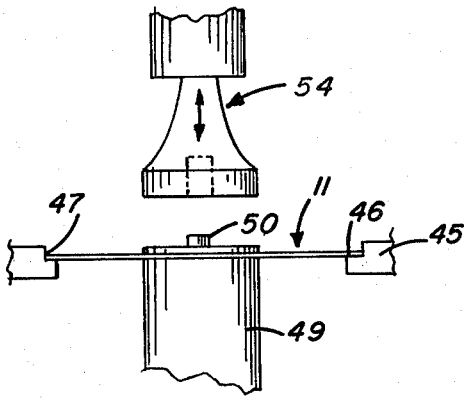
FIG. 5 is a schematic front elevational view depicting the film unit of FIG. 1 during alignment and assembly in an exemplary ultrasonic welding device.
Figure 6:
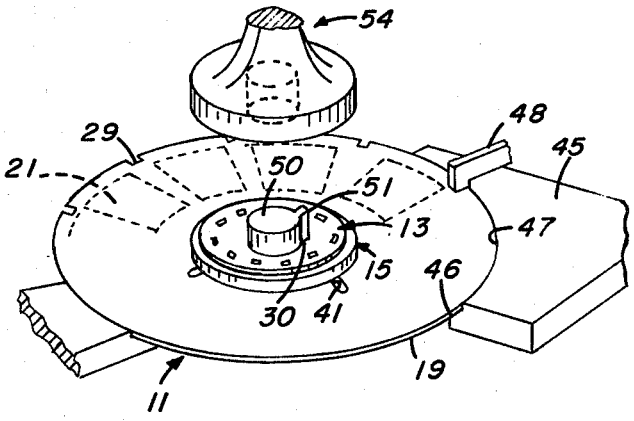
FIG. 6 is a partial perspective view of the alignment and ultrasonic welding device, illustrating the method of accurately aligning the disk relative to the hub.

The alignment between the hub and the film disk is determined very accurately during final assembly by the assembly equipment. Referring to FIGS. 5 and 6, the film disk is positioned in a chuck 45, which supports the underside of the disk on a ledge 46. A circular abutment lip 47 fits precisely around the disk and accurately determines its radial position. At the same time, a key 48 (FIG. 6) precisely fits into one of the disk notches 29 to accurately determine the angular position of the disk. The hub is then located within the central disk aperture by a second chuck 49 (FIG. 5), preferably coupled to the first chuck, for aligning the hub relative to the disk both radially and angularly. The relative radial position is established by a spindle 50, received in hub sleeve 23, while the angular position is established by a key 51 (FIG. 6) received in hub keyway 30.

An ultrasonic device suitable for applying the retainer ring is depicted in FIGS. 5 and 6. The device includes the second chuck 49, which supports the hub accurately in the film-disk aperture, and an ultrasonic horn 54, which is movable toward the chuck to clamp the film unit parts therebetween. With the retainer ring received on the stepped portion 44 of the hub, and the film disk aligned between the ring and flange 33, the horn is vibrated ultrasonically in engagement with the ring. In a manner well known to those skilled in the art, the energy from the horn will vibrate the parts at their interfaces, where the thermoplastic fill material has been located, generating heat and causing the fill material to melt. Gravity, and resilient pressure exerted by the horn, will then cause the melted fill material to flow into the spaces between the hub and the disk where it is permitted to harden. Thus, the film disk is immobilized on the hub, and the retainer ring is adhered to the hub, by the hardened thermoplastic.

Figure 8:
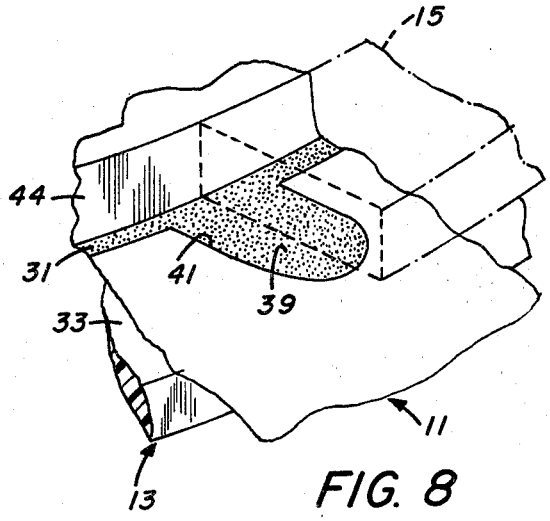
FIG. 8 is a partial perspective view of the assembled film unit of FIG. 7, illustrating the mass of material filled between the hub and the film disk.
Figure 9:
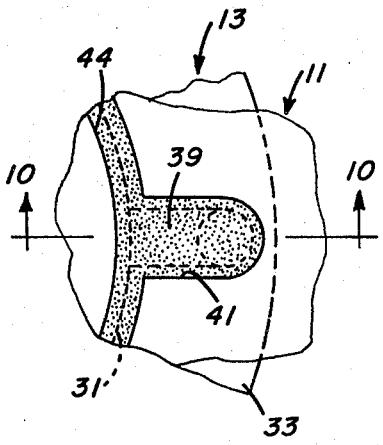
FIG. 9 is a top view corresponding to FIG. 8, but with the retainer ring removed, depicting the mass of fill material between the film disk and the hub.
Figure 10:
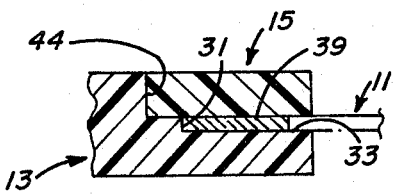
FIG. 10 is a front elevational view corresponding to FIG. 8, depicting the retainer ring bonded to the hub with the film disk captured therebetween, and with the interstices filled between the film disk, the hub, and the ring to exclude foreign matter therefrom.

The hub and spokes are illustrated assembled with the film disk in FIGS. 8–10, which depict the hardened thermoplastic material after it has been melted by the ultrasonic device and filled into the interstices between the hub, the disk, and the retainer ring. The melted thermoplastic blocks relative movement of the disk and the hub, and thereby retains the alignment established by the assembly equipment without undesirably stressing the film disk.

It should now be apparent that the structure of the present invention provides important advantages. The respective parts can be manufactured to very loose tolerances. Numerous production lines can be used to form the parts, without particular concern about matching the production lines to produce identical parts. Similarly, during assembly, the loose fit facilitates the mounting of the disk on the hub rim. At the same time, however, very accurate alignment is achieved between the hub and the film disk, not by the dimensions of such parts, but by the assembly equipment, which aligns the parts and then fixes that alignment. Still further, the disk is immobilized on the hub in a manner that reduces any distorting stresses in the disk, since the disk material is not melted or otherwise subjected to distorting heat. More specifically it is captured between a retainer ring and various surfaces on the hub, including the rim 31, the flange 33, and the spokes 39. Moreover, the thermoplastic material adheres the ring to the hub and fills the spaces between the ring, the film disk, and the hub to exclude foreign material, such as processing composition.

The invention has been described in detail with particular reference to an illustrative preferred embodiment thereof, but it should be understood that variations and modifications can be effected within the spirit and scope of the invention as described hereinabove and as defined in the appended claims.

We claim:

1. A photographic film unit comprising:

an annular photosensitive sheet having a central aperture;

a thermoplastic hub received in the central aperture with clearance to permit movement between said sheet and said hub; and a mass of thermoplastic material melted from said hub into the clearance between said hub and said sheet to immobilize said sheet relative to said hub.

2. An assembled photographic film unit comprising:

a photosensitive disk having a central aperture therethrough;

a thermoplastic hub received in the central aperture for supporting said disk, the aperture providing sufficient clearance with said hub to permit the establishment of relative alignment between said hub and said disk during assembly of the film unit; and a hard mass of material deposited in said clearance by flowing such material from said hub into said clearance to maintain the relative alignment between said hub and said disk.

3. An assembled photographic film unit comprising:

a photosensitive sheet having a generally circular outer perimeter and a central aperture;

a hub received in the central aperture to support the photosensitive sheet in approximate alignment relative to said hub, said hub including an annular ring of thermoplastic material; and a mass of said thermoplastic material melted from said hub to flow between said hub and said sheet and hardened for accurately establishing the relative alignment between said hub and said sheet.

4. A photographic film unit assembled from respective parts; said film unit comprising:

a flat and generally circular photosensitive part having a central aperture therethrough;

a thermoplastic hub part received in the central aperture for supporting said photosensitive part, the dimensions of the aperture providing sufficient clearance with the dimensions of said hub so that said dimensions only approximately determine the relative alignment between said hub part and said photosensitive part during assembly; and a firm mass of thermoplastic material melted from said hub part to the clearance to determine the relative alignment between said hub part and said photosensitive part.

5. An assembled photographic film unit for use in associated apparatus; the film unit comprising:

a film disk having a central aperture;

a hub fitted into the aperture for supporting the film disk in associated apparatus, the fit between said hub and said film disk providing clearance for alignment during assembly of the film unit; and a mass of thermoplastic material flowed from said hub into the clearance to maintain alignment after assembly between said hub and said film disk.

6. The invention claimed in claim 5 wherein said thermoplastic mass entirely fills said clearance to exclude foreign matter therefrom.

7. The invention claimed in claim 5 further including a retainer ring for capturing said film disk against said hub, and wherein said thermoplastic material is adhered to said ring and to said hub.

8. An assembled photographic film unit comprising:

a film disk having a central aperture;

a retainer ring having a central aperture;

a thermoplastic hub received in the apertures of the film disk and the ring, at least the film disk aperture providing sufficient clearance with the hub to permit alignment between said hub and said film disk during assembly; and a hardened mass of thermoplastic material flowed from said hub into the clearance to maintain alignment between said hub and said film disk after assembly, said mass adhering said ring to said hub with the film disk captured therebetween.

9. The invention claimed in claim 8, wherein the thermoplastic material is flowed from said hub and is caused to flow into the clearance by ultrasonic energy.

10. An assembled photographic unit comprising:

a film disk having a central aperture and at least one additional aperture;

a hub including a thermoplastic core loosely received in the central aperture to approximately establish radial alignment between said hub and said film disk, and a thermoplastic key loosely received in the additional aperture to approximately establish angular alignment between said hub and said film disk, the looseness permitting alignment between said hub and said film disk, both radially and angularly, during assembly of the film unit; and a hardened mass of material flowed from said core to between said core and the central aperture, and a hardened mass of key material flowed between said key and the additional aperture, to maintain alignment between said hub and said film disk, both radially and angularly, after assembly of said film unit.

11. The invention claimed in claim 10, further including a flange on said hub; and a ring for trapping said film disk against said flange; and wherein the hardened mass adheres said ring to said hub with the film disk captured therebetween.

12. A photographic film unit comprising:

a photosensitive film disk including a central aperture and at least one notch extending radially outward from the aperture;

a thermoplastic hub for supporting the film disk, the hub including a stepped rim having a cylindrical surface adapted to be loosely received in the central aperture of said film disk, a radially extending annular surface for engaging one face of said film disk, and at least one spoke extending radially outwardly from said cylindrical surface along said annular surface, said spoke adapted to be received in the notch to limit relative rotation between said film disk and said hub; and a hardened mass of hub material deposited by flowing between the cylindrical hub surface and said film disk aperture to establish and maintain alignment between said film disk and said hub.

13. A photographic film unit comprising:

a film disk including a central aperture and at least one notch extending radially outward from the aperture;

a hub for supporting the film disk, the hub including a stepped rim having a cylindrical band adapted to be loosely received in the central aperture of said film disk to limit radial alignment between said film disk and said hub, a radially extending annular surface for engaging one face of said film disk, and at least one spoke extending radially outwardly from said cylindrical band along said annular surface, said spoke adapted to be loosely received in the notch to limit relative rotation between said film disk and said hub;

a retaining ring for securing said film disk to said hub, said retaining ring having an annular surface engaging the other face of said film disk opposite said annular surface of said hub;

at least one of said hub and said ring including thermoplastic material; and a hardened mass of said hub or ring thermoplastic material deposited between the cylindrical band and said film disk at the aperture, and between said spoke and said film disk at the notch;

whereby the hardened mass establishes the final relative positions of the hub and film disk both radially and angularly.

* * * * *